US005964034A

United States Patent [19]

Sueyoshi et al.

[11] Patent Number: 5,964,034

[45] Date of Patent: Oct. 12, 1999

[54] ELECTRIC SHAVER HAVING FLOATING TRIMMER BLADES, A MAIN BLADE, AND HAIR RAISING PORTIONS

[75] Inventors: Hidekazu Sueyoshi; Toshio Ikuta, both of Osaka, Japan

[73] Assignee: Matsushita Electric Works, Ltd., Osaka, Japan

[21] Appl. No.: 08/882,576

[22] Filed: Jun. 25, 1997

[30] Foreign Application Priority Data

Jun. 25, 1996 [JP] Japan ..... 8-164961
Jul. 25, 1996 [JP] Japan ..... 8-196716

[51] Int. Cl.[6] ..... B26B 19/42; A45D 27/38

[52] U.S. Cl. ..... 30/34.2; 30/43.92

[58] Field of Search ..... 30/34.1, 34.2, 30/43.1, 43.92

[56] References Cited

U.S. PATENT DOCUMENTS

| | | | |
|---|---|---|---|
| 2,670,534 | 3/1954 | Haber | 30/34.2 |
| 2,711,015 | 6/1955 | Scully | 30/34.2 |
| 2,870,534 | 1/1959 | Angst et al. | 30/34.1 |
| 3,774,300 | 11/1973 | Konig | 30/34.1 |
| 3,834,017 | 9/1974 | Tolmie | 30/34.2 |
| 4,174,568 | 11/1979 | Mixner | 30/34.1 |
| 4,866,843 | 9/1989 | Kumano | 30/34.1 |
| 4,896,420 | 1/1990 | Locke | 30/34.2 |
| 4,922,608 | 5/1990 | Pahl | 30/34.1 |
| 5,249,361 | 10/1993 | Apprille, Jr. et al. | 30/34.2 |
| 5,706,582 | 1/1998 | Hosokawa et al. | 30/34.2 |
| 5,711,076 | 1/1998 | Yin et al. | 30/34.2 |

FOREIGN PATENT DOCUMENTS

| | | | |
|---|---|---|---|
| 43 13 371 A1 | 10/1993 | Germany | B26B 19/04 |
| 44 18 644 A1 | 12/1994 | Germany | B26B 19/04 |
| 4-231991 | 8/1992 | Japan | B26B 19/10 |
| 5-56063 | 7/1993 | Japan | B26B 19/42 |
| 7-144074 | 6/1995 | Japan | B26B 19/10 |
| 8-141227 | 6/1996 | Japan . | |
| 2 199 529 | 7/1988 | United Kingdom | 30/34.2 |

OTHER PUBLICATIONS

German Patent Office Letter dated Oct. 8, 1997–English Language Translation provided.

*Primary Examiner*—Rinaldi I. Rada
*Assistant Examiner*—Gyounghyun Bae
*Attorney, Agent, or Firm*—Sughrue, Mion, Zinn, Macpeak & Seas, PLLC

[57] ABSTRACT

An electric shaver includes a main blade 1 having an external blade formed with a large number of blade holes and an internal blade coming in sliding contact with an inner face of the external blade and trimmer blades 2 being disposed in the proximity of the main blade, each with a blade edge directed in a direction away from the main blade so that the trimmer blades 2 and the main blade 1 can be brought into contact with a skin surface at the same time. Hair raising members 8 are projected on a blade cover 24 covering the top faces of blade members of the trimmer blades 2. When the electric shaver is moved along a skin surface, the hair raising members 8 on the blade cover 24 raise hair, thereby enhancing the hair introduction efficiency into the main blade 1.

17 Claims, 17 Drawing Sheets

ELECTRIC SHAVER HAVING FLOATING TRIMMER BLADES, A MAIN BLADE, AND HAIR RAISING PORTIONS

BACKGROUND OF THE INVENTION b 1.Field of the Invention

This invention relates to an electric shaver and in particular to an electric shaver with both a trimmer blade for rough shaving and a main blade for finish shaving coming in contact with a skin surface at the same time.

2. Related Art

An electric shaver with both a trimmer blade for rough shaving and a main blade for finish shaving, wherein both blades come in contact with a skin surface at the same time, can be used to cut long hairs and short hairs. Long hairs can be cut with the trimmer blade and shorter hairs, which have been shortened with the trimmer blade can be cut with the main blade at the same time, so that body hair including a beard can be shaved rapidly.

However, if both the trimmer and main blades can come in contact with a skin surface at the same time, normally a blade cover is positioned at the top end of the trimmer blade having a blade edge directed in a direction away from the main blade. The blade cover is positioned between the edge of the trimmer blade coming in contact with a skin surface and the main blade coming in contact with a skin surface so that the blade cover also comes in contact with the skin surface. When the electric shaver is moved along a skin surface, the blade cover often lays hair down, resulting in degradation of efficiency in introducing hair into the main blade.

Thus, with an electric shaver disclosed in Japanese Patent Laid-Open No. Hei 7-144074, a large number of grooves, running in a direction connecting the blade edges of a trimmer blade, and a main blade are made in the top face of a blade cover. The blade cover is positioned between the blade edge of the trimmer blade and the main blade so that hair is passed through the grooves, thereby suppressing occurrence of a state in which hair is laid down.

With the electric shaver having grooves made in the blade cover, hair laid down by the blade cover is decreased and hair that can be introduced into the main blade increases accordingly. However, the grooves in the blade cover provide only hair passages and cannot raise laid hair. Thus, an incomplete shave cannot be realized.

SUMMARY OF THE INVENTION

It is therefore an object of the invention to provide an electric shaver which achieves a complete shave and rapid finish shaving.

According to the invention, there is provided an electric shaver comprising a main blade consisting of an external blade formed with a large number of blade holes and an internal blade coming in sliding contact with an inner face of the external blade and trimmer blades being disposed in the proximity of the main blade, each with a blade edge directed in a direction away from the main blade so that the trimmer blades and the main blade can be brought into contact with a skin surface at the same time. The electric shaver is further characterized by a hair raising member projected on a blade cover covering the top faces of blade members of the trimmer blades. According to the invention, when the electric shaver is moved along a skin surface, the hair raising member on the blade cover raises hair, thereby enhancing the hair efficiency of introducing hair into the main blade.

According to the present invention, there is provided an electric shaver comprising a trimmer blade slidably supported and floated by a spring which urges said trimmer blade toward a projecting direction within a predetermined area; an operation portion for subjecting the trimmer blade to a sliding operation wherein the trimmer blade extends beyond the predetermined area, and linking means for connecting the trimmer blade and operating portion in such a manner that the trimmer blade and the operating portion are not linked when the trimmer blade is floated but are linked when the trimmer blade is slid up by the operating portion.

Since the trimmer blade is freely floated, the hair cutting efficiency of the trimmer blade is high. Moreover, the contact position between the skin surface and the hair raising member provided on the trimmer blade is changed due to the floating operation of the trimmer blade. When the trimmer blade is positioned on a top point of a float operation, the tip portion of the hair raising member is positioned above a line defined between the peak portion of main blade and the tip portion of comb-like blade of the trimmer blade. When the trimmer blade is positioned on a bottom point, the tip portion of the hair raising member is positioned in vicinity of the line.

As a result, when the trimmer blade is positioned on the upper point, the soft hair raising member is deformed at the proximal portion to raise hair. When the trimmer blade is positioned on bottom point, the tip portion of the hair raising member is contacted with the skin to raise laid-down hair. Thus, because the trimmer blade is floated, the laid-down hair raising effect is achieved.

The tip portion of the hair raising member is positioned below a line defined between the peak portion of main blade and the tip portion of comb-like blade of the trimmer blade. Since the skin surface has flexibility, the peak portion of the main blade and the tip portion of the trimmer blade are urged and pushed to the skin so that the skin is projected between the main blade and the trimmer blade. Thus, it is possible to always contact the tip portion of the hair raising member.

Preferably, the hair raising member is made of elastomer and is fixed to the blade cover of a molded article. In this case, preferably the blade cover is fitted into the hair raising member in a thickness direction.

Preferably, the top end of the hair raising member is positioned at a height in the range of ±2 mm relative to the top of the main blade. Further, the hair raising member may be formed of a plurality of fine ribs. Preferably, the trimmer blade, including the elastic hair raising member on the blade cover, are floated.

BRIEF DESCRIPTION OF THE DRAWING

In the accompanying drawings:

FIG. 16(*a*) is a fragmentary back view and FIG. 16(*b*) is a partial sectional view.

DETAILED DESCRIPTION OF THE PREFERRED EMBODIMENTS

Figure 2:
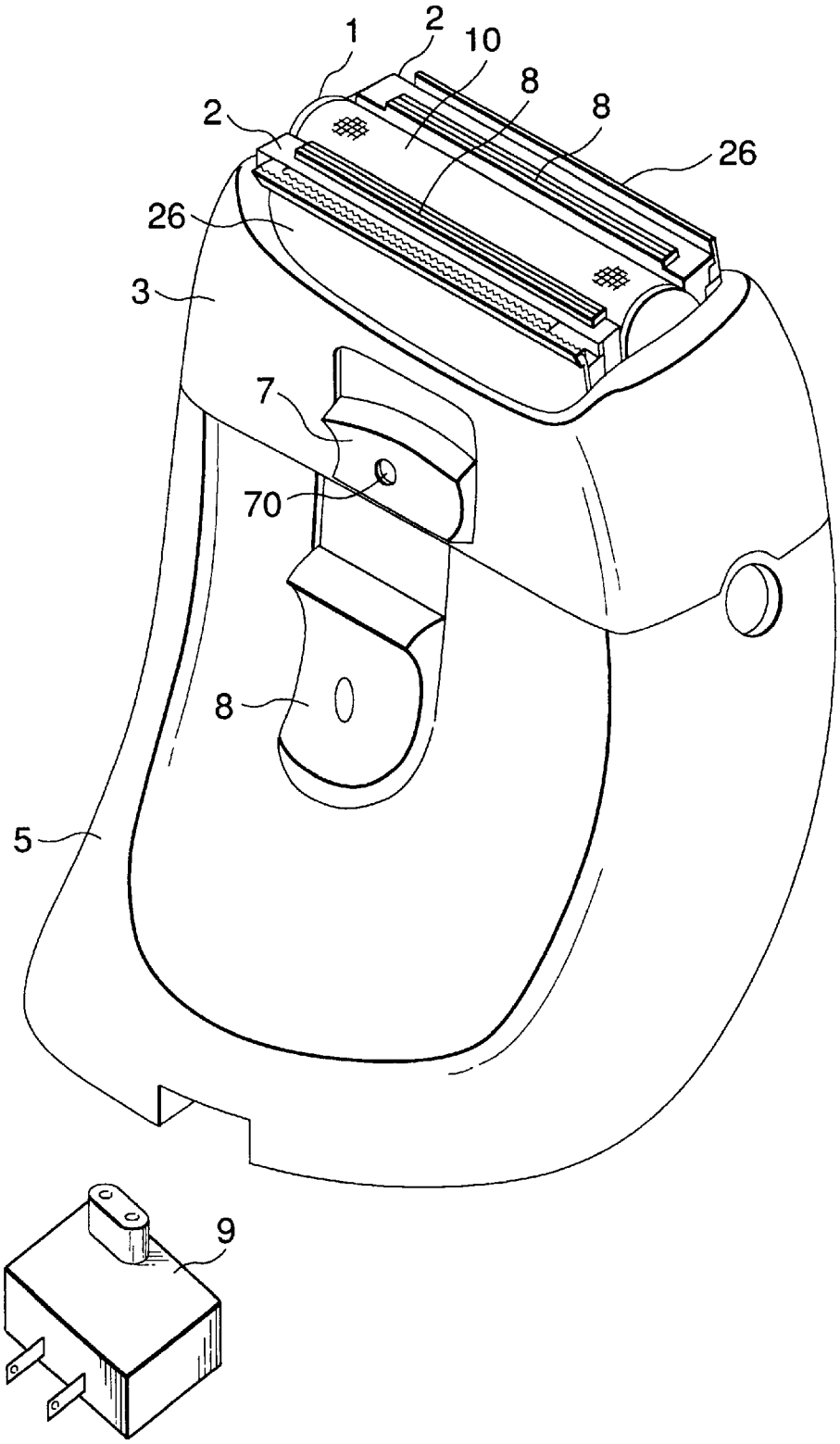
FIG. 2 is a perspective view of the first embodiment of the invention.
Figure 3:
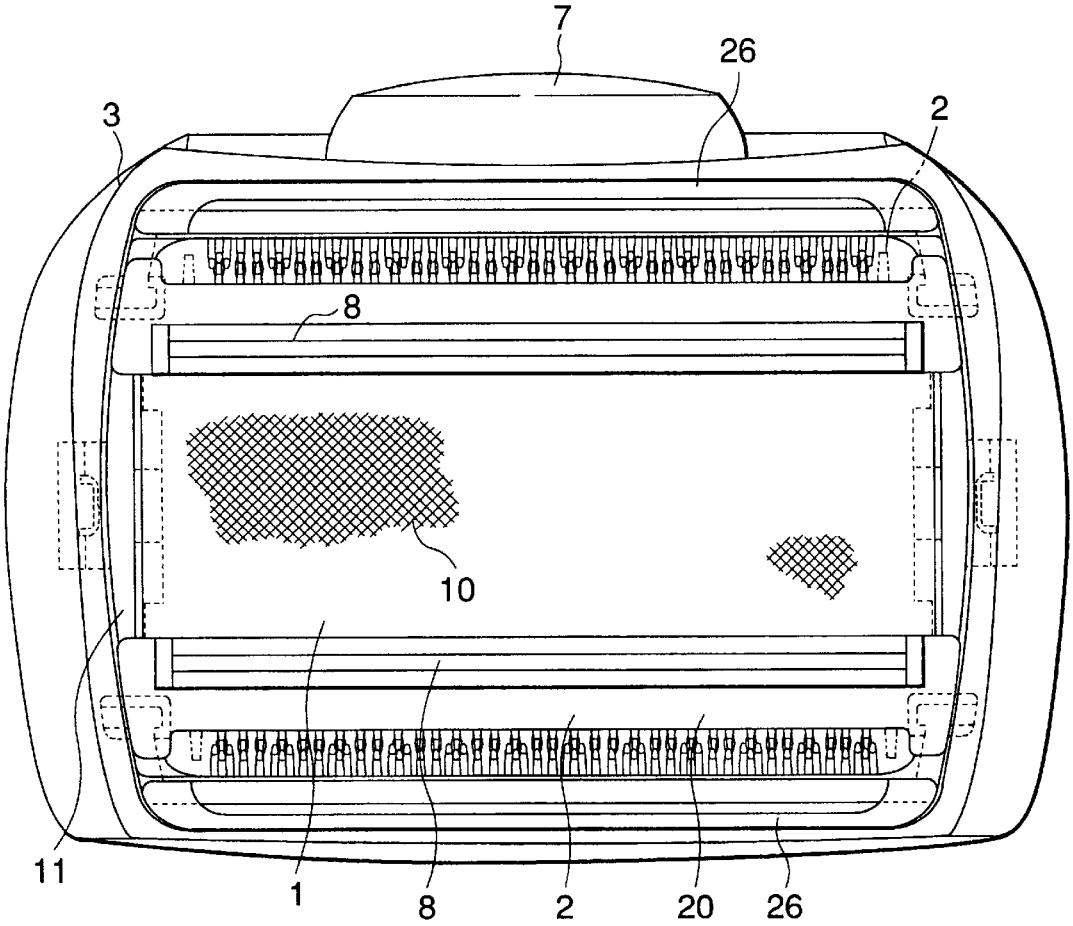
FIG. 3 is a plan view of the first embodiment of the invention.
Figure 4:
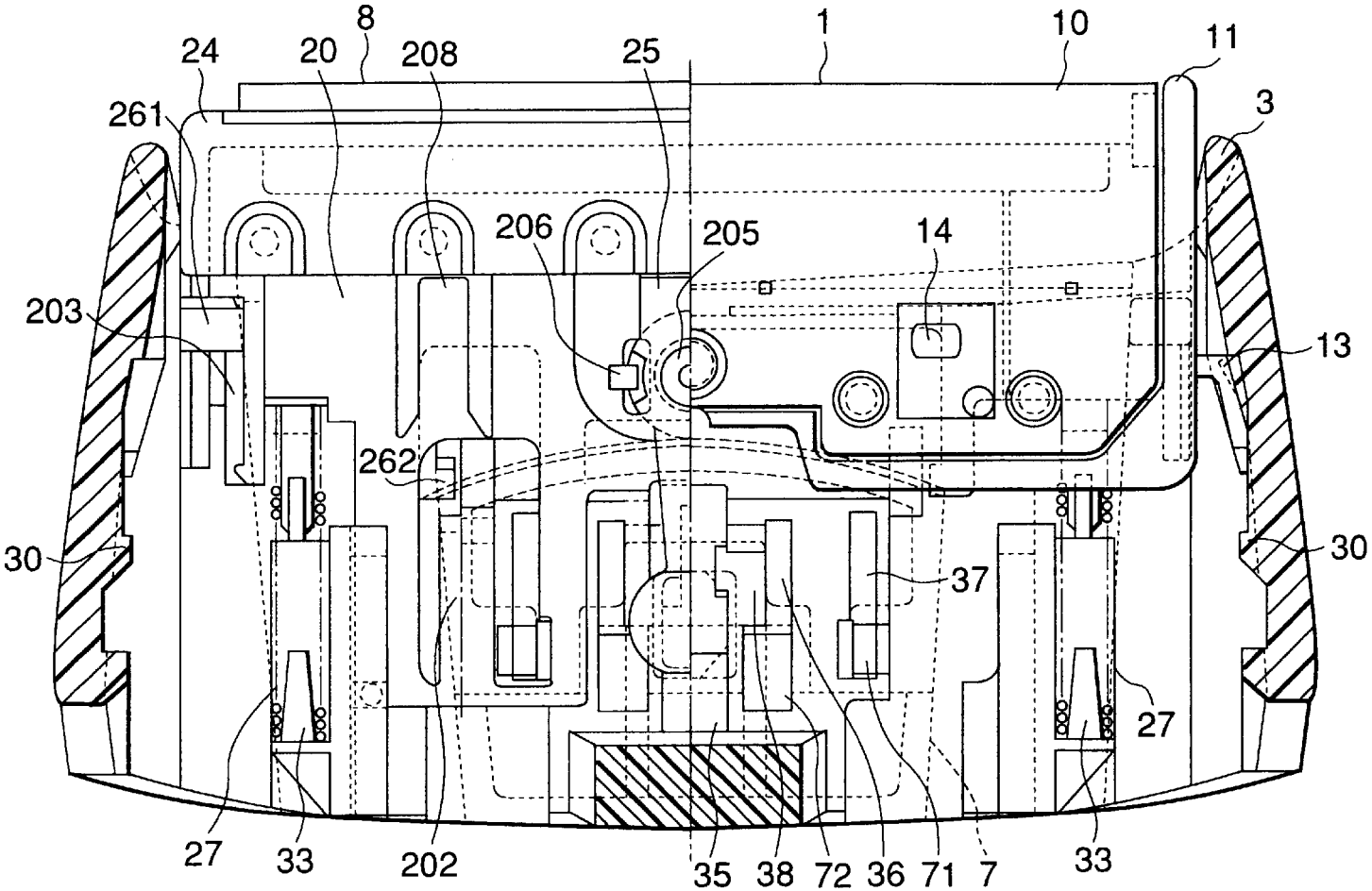
FIG. 4 is a transverse sectional view of the first embodiment of the invention.

As shown in the figures, an electric shaver has a blade head 1 and a pair of blade heads 2 and 2, of a trimmer blade type, adjacent to both sides of the blade head 1. The blade head 1 and the blade heads 2 and 2 are disposed parallel to one another on the top end of a main body 5. The three blade heads 2, 1, 2 are simultaneously driven by a motor (not shown). In FIG. 2, numeral 8 is a switch and numeral 9 is a charger.

Figure 5:
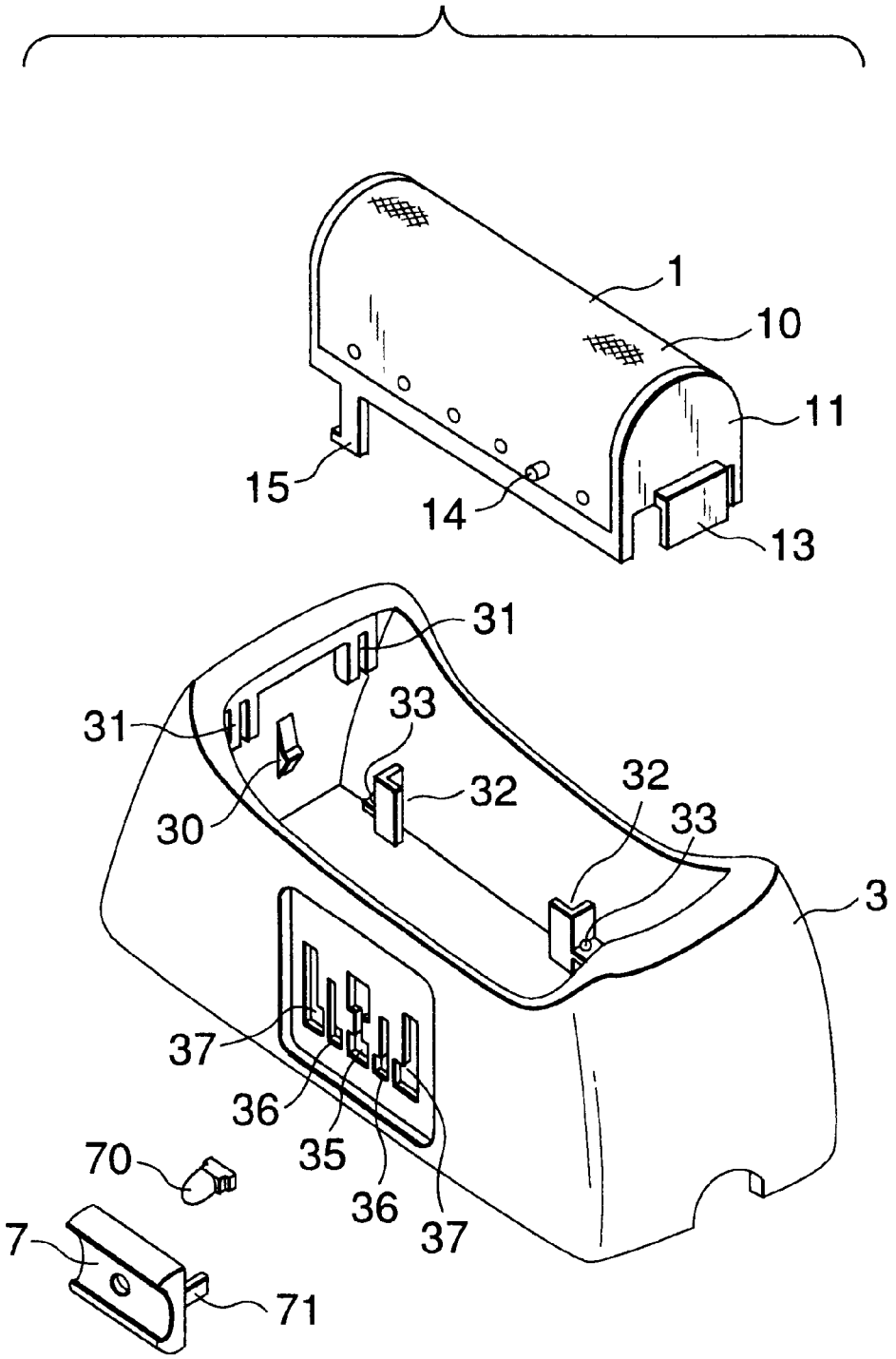
FIG. 5 is an exploded perspective view of a blade head, an external cassette, and a slide button of the first embodiment of the invention.

The blade type head 1 of a main blade, which is formed of a metal thin plate, consists of an external blade 10 formed with a large number of blade holes, an internal cassette 11 shaped like a rectangular frame for holding the external blade 10 by a heat seal, and an internal blade 12 coming in sliding contact with the inner face of the external blade 10. The internal cassette 11 comprises an elastic piece 13 on both end faces as shown in FIG. 5.

The blade head 1 is mounted on the main body 5 via an external cassette 3. The external cassette 3 is shaped like a rectangular frame by synthetic resin molding as shown in FIG. 5. External cassette 3 comprises a reception piece 30 centered in the width direction of the inner face of each end. Guide grooves 31 are located on both sides of the reception piece 30. Guide grooves 32 and spring receptacles 33 are located adjacent one another on the inner face of a side portion of the reception piece 30. The internal cassette 11, comprising the external blade 10 of the blade head 1, is housed in the external cassette 3 through a lower opening of the external cassette 3 and the elastic pieces 13 are positioned above the reception pieces 30, thereby preventing removal yet enabling a move in a small up and down range relative to the external cassette 3. Projections 15 made on the internal cassette 11 are provided for the user to put fingers thereon when the user removes the internal cassette 11 from the external cassette 3.

Figure 6:
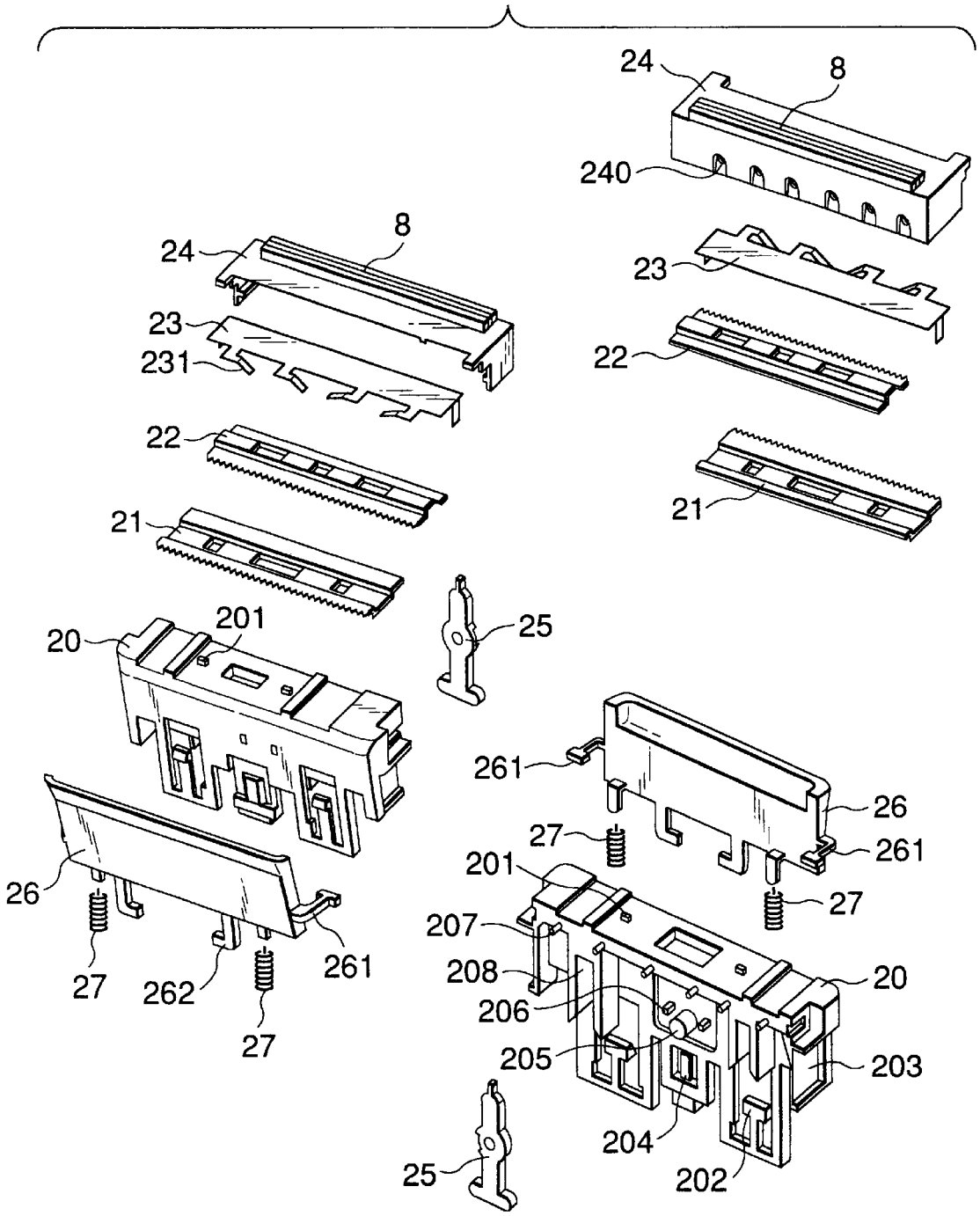
FIG. 6 is an exploded perspective view of a trimmer blade of the first embodiment of the invention.
Figure 7:
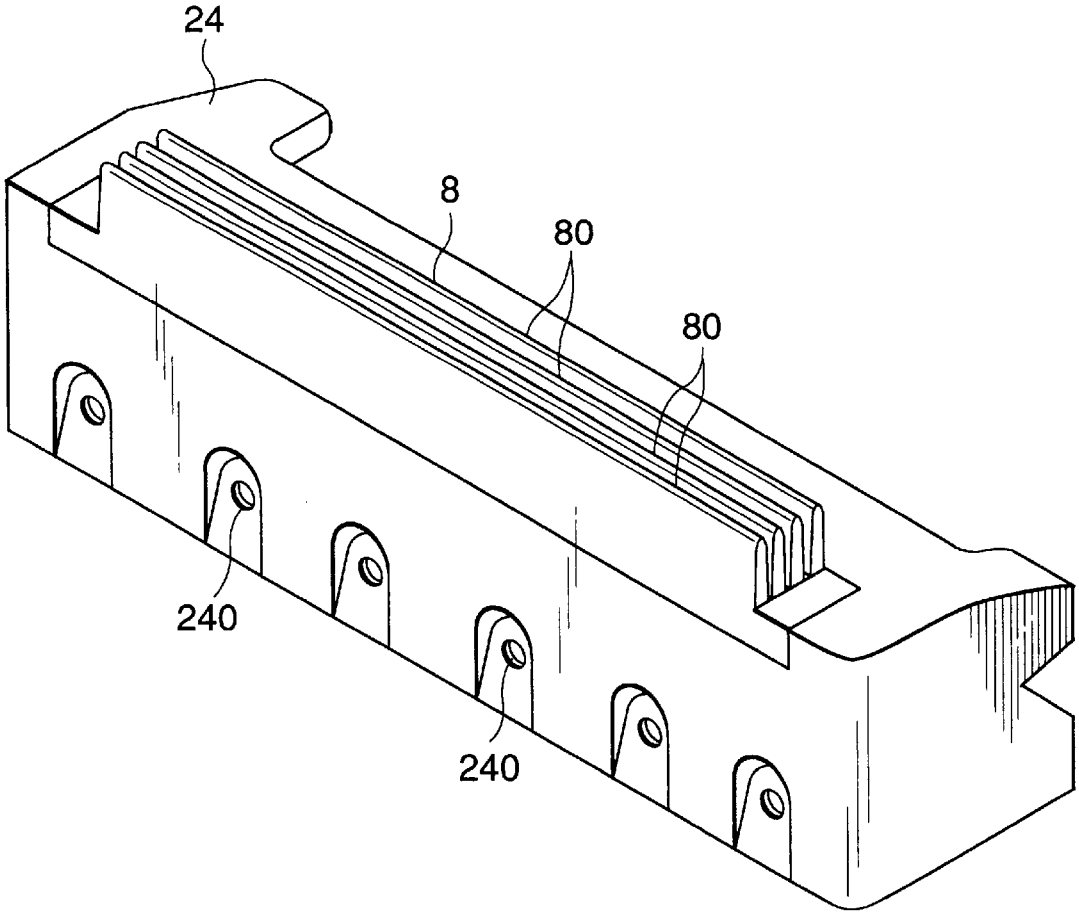
FIG. 7 is a perspective view of a blade cover and a hair raising member of the first embodiment of the invention.

As shown in FIG. 6, each of the two blade heads 2 of trimmer blade type comprises a trimmer base 20, a fixed blade 21 fitted into a fit projection 201 on the top face of the trimmer base 20, and a moving blade 22 disposed on the top face of the fixed blade 21 and guided slidably by the fit projection 201 Each blade head 2 also includes a press spring 23 being coupled to the trimmer base 20 for pressing the moving blade 22 against the fixed blade 21 by spring pieces 231 Further, each blade head 2 includes a blade cover 24 covering the top face of the press spring 23 and coupled to the trimmer base 20, and a trimmer drive piece 25 having a top end engaging the moving blade 22 Still further, each blade head 2 includes a skin touch guide 26 mounted on the trimmer base 20, and float springs 27. The trimmer drive piece 25 is pivotally supported at the up and down center by a stem 205 placed on the trimmer base 20. In FIG. 6, numeral 206 is a hook engaging the trimmer drive piece 25 for preventing the trimmer drive piece 25 from becoming dislodged and numeral 207 is a pin inserted into a connection hole 240 of the blade cover 24 for fixing the blade cover 24.

When the skin touch guide 26 is attached to the trimmer base 20, projection pieces 262 projected from the lower end of the skin touch guide 26 are placed on the top face of an elastic push-up piece 202 formed on the trimmer base 20. Hooks 261 projected from both sides come in contact with the lower faces of upper walls of engagement recesses 203 made in the side faces of the trimmer base 20, whereby the skin touch guide 26 is integrated into the trimmer base 20.

The two blade heads 2 and 2 are also disposed in the external cassette 3. At this time, engagement of the trimmer base 20 and the guide grooves 32 as well as and engagement of the hooks 261 of the skin touch guide 260 and the guide grooves 31 enable the blade heads to slide in a small up and down range relative to the external cassette 3. The blade heads 2 are energized upward by the float springs 27 disposed between the lower face of the skin touch guide 26 and the spring receptacles 33 of the external cassette 3.

Figure 1:
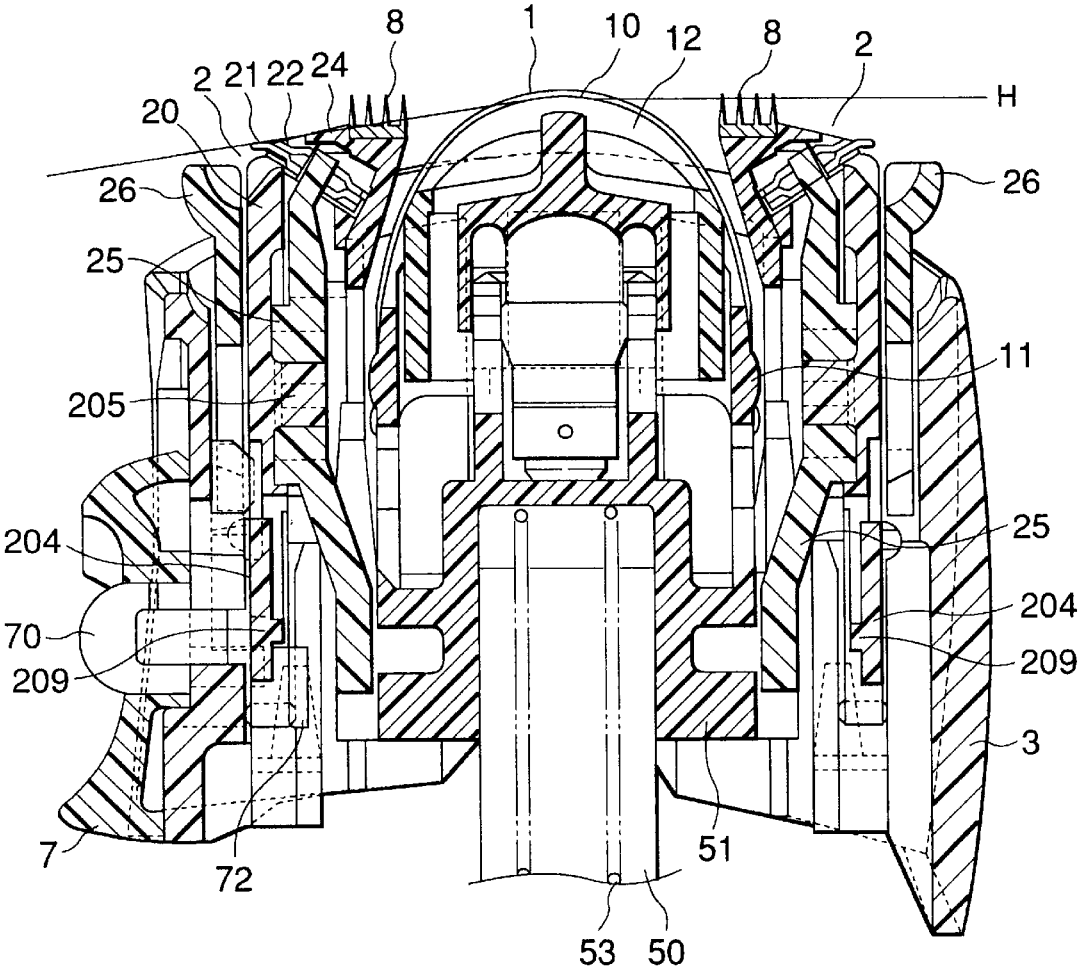
FIG. 1 is a fragmentary longitudinal sectional view of a first embodiment of the invention.

As shown in FIG. 1, the internal blade 12 in the blade head 1 is coupled to a reciprocating drive piece 50 via a joint 51, whereby it is reciprocated. Also, the internal blade 12 is energized upward by a push-up spring 53 and comes in contact with the inner face of the external blade 10. The blade head 1 can also be floated by the spring force of the push-up spring 53. The joint 51 has also an engagement part with the lower end of the trimmer drive piece 25 of each blade head 2. Thus, when the internal blade 12 of the blade head 1 is reciprocated, the moving blade 22 of the blade head 2 is also reciprocated via the trimmer drive piece 25.

Figure 9:
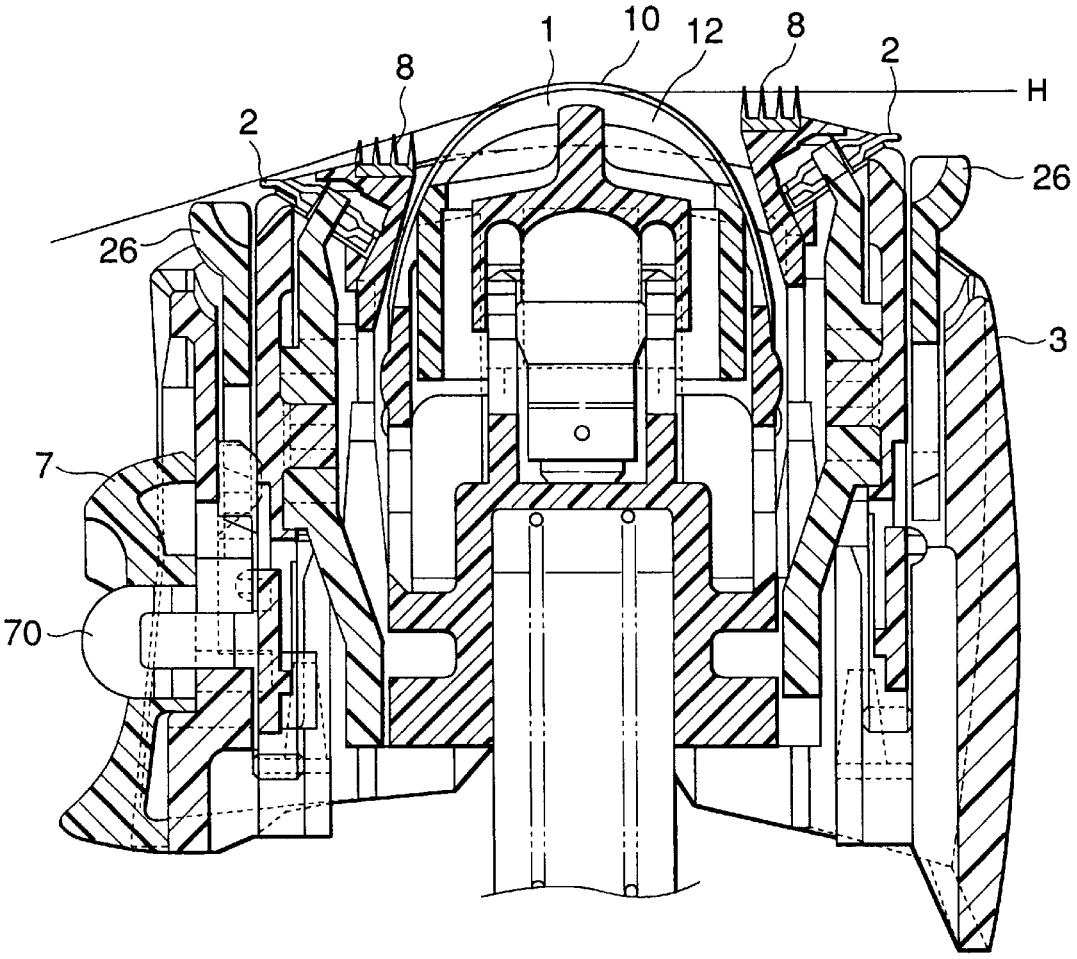
FIG. 9 is a fragmentary longitudinal sectional view to show a state at the float time in the first embodiment of the invention.

The blade head 2 is floated by the spring force of the float springs 27. If the blade head 2 is pressed against a skin surface, it sinks against the float springs 27 as shown in FIG. 9. Since a projection 14, shown in FIG. 5, projected from the internal cassette 11 of the blade head 1 is positioned in an engagement groove 208 opened downward in the trimmer base 20 of the blade head 2, the blade head 1 also sinks in association from an intermediate point of the sink operation of the blade head 2.

Further, since the projection pieces 262 of the skin touch guide 26 are placed on the top face of the push-up piece 202 of the trimmer base 20 and the hooks 261 are in contact with the lower faces of the upper walls of the engagement recesses 203 of the trimmer base 20 as described above, the skin touch guide 26 is integrated into the trimmer base 20. When the skin touch guide 26 moves up and down, the trimmer base 20 also moves up and down at the same time.

Further, when the trimmer base 20 moves up and down, the skin touch guide 26 also moves up and down. This means that the skin touch guide 26 and the trimmer base 20 receive the spring force of the float springs 27 and are floated at the same time.

An elastic hair raising member 8 is made up of a plurality of ribs 80, made of elastomer, and is attached to the portion of the blade head 2 of the trimmer blade type In particular, the hair raising member 8 is formed on the top face of the blade cover 24, and is on the side thereof closest to the blade head 1. The ribs 80 are arranged in parallel with the lengths of the blade edges of the blade heads 2 and the blade head 1 The top end of the hair raising member 8 is positioned at almost the same place as height H of the top end of the blade head 1, as shown in FIG. 9. Thus, when the blade heads 1 and 2 are pressed against skin S, the hair raising member 8 also comes in contact with the skin S.

When the electric shaver is moved so as to cut hair with the blade head 1 of the main blade for finish shaving after hair is cut with the rough shaving blade heads 2 of trimmer blade type, the skin S of the portion having hair cut with the blade edges of the blade heads 2 comes in contact with the hair raising member 8 and then the blade head 1. At this time, the elastic hair raising member 8, made up of a plurality of ribs 80, is caught in hair for raising the hair and stretches the skin in the portion between the hair raising member 8 and the blade head 1 for raising hair. The hair raising member 8 raises even laid-down hair just before the blade head 1 comes in contact with the hair. If the hair passing through the portion of the hair raising member 8 attempts again to lay itself down, it is caught in the blade head 1 and is cut before the hair is laid down. The hair angle when the hair is caught becomes the angle most easily introduced into the external blade 10 of the blade head 1; the hair raising members 8 greatly improve the hair introduction efficiency into the blade head 1.

Particularly in the example shown in the figures, the contact part of the hair raising member 8 with the skin S is made up of a plurality of fine and easy-to-bend ribs 80. Thus, when the hair raising member 8 is pressed against the skin S, it comes in reliable contact with the skin S over the full length of the hair raising member 8 regardless of asperities of the skin S. In addition, the blade head 2 provided with the hair raising member 8 can be floated, so that the hair raising member 8 comes in contact with the skin S by a proper force and raises hair reliably.

Further, when the blade head 2 is put in the floating operation, the slide button 7 for sliding up the blade head 2 is completely separated from the blade head 2 so that the slide button 7 do not influence to the floating operation of the blade head 2.

The hair raising member 8 is attached to the blade cover 24 by thermal welding. At this time, preferably the base of the hair raising member 8 is fitted into the blade cover 24, whereby the hair raising member 8 becomes hard to be dislodged from the blade cover 24.

Figure 10:
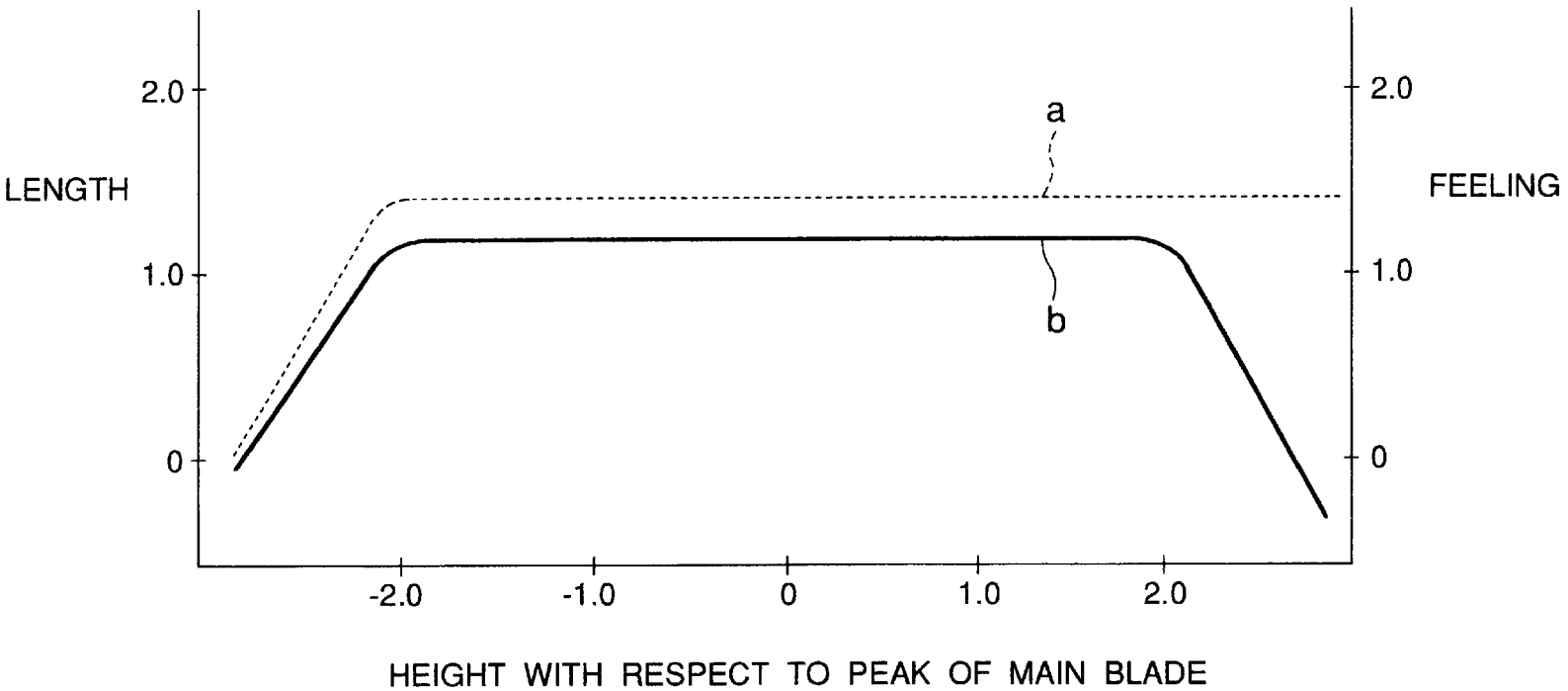
FIG. 10 is an illustration to show characteristic change responsive to the height of the hair raising member of the first embodiment of the invention.

The top end of the hair raising member 8 is set to almost the same height as the top position H of the blade head 1 of the main blade. If the top end of the hair raising member 8 is much higher than the top position H of the blade head 1, sufficient contact pressure between the blade head 1 and the skin S cannot be provided because of the hair raising member 8 and thus hair cannot be cut short. If the top end of the hair raising member 8 is too much lower than the top position H of the blade head 1, the sufficient hair raising effect of the hair raising member 8 cannot be produced. Preferably, the top end of the hair raising member 8 is set within 2 mm above or below the H position. FIG. 10 shows how cut hair shortness b and skin touch a change depending on the height of the hair raising member 8.

The lock button 70 is urged outwardly elastic piece 204. Therefore, there is not in play the lock button 70.

Figure 11:
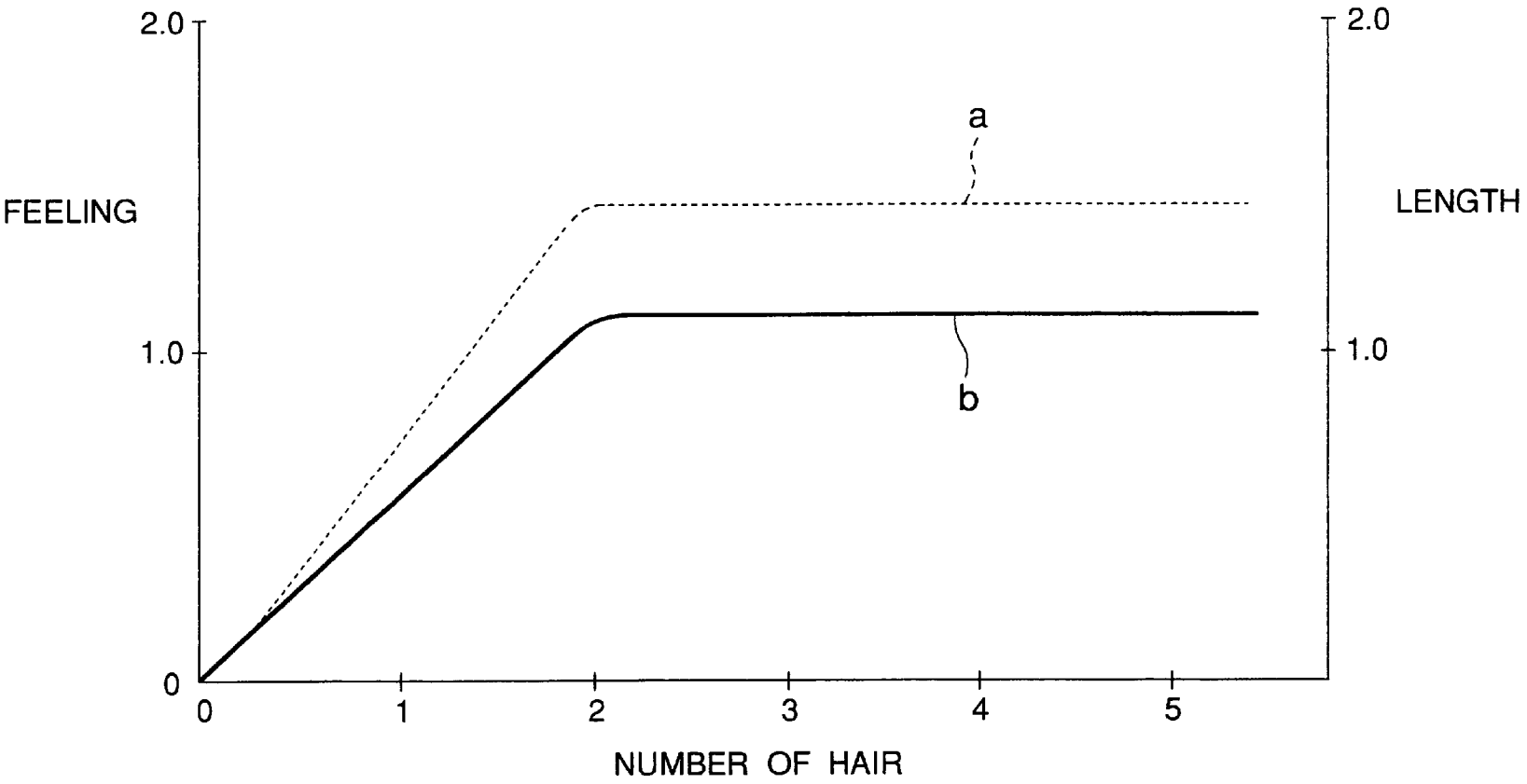
FIG. 11 is an illustration to show characteristic change responsive to the number of ribs of the hair raising member of the first embodiment of the invention.

When the hair raising member 8 is made of the ribs 80, the effect of the number of the ribs 80 on the cut hair shortness b and skin touch a is important. The result is as shown in FIG. 11. If the number of the ribs 80 is two or more, a good result can be produced.

By the way, when the electric shaver is pressed against a soft skin like an armpit, the skin touch guides 26 are provided to prevent the skin from entering, and getting injured by the blade edge of the moving blade 22 or the fixed blade 21 of the blade head 2 of trimmer blade type. The blade heads 2 and the skin touch guides 26 are integral with each other in the description given above. However, with one blade head 2, a slide button 7 placed on the outer face of the external cassette 3 can be handled to separate the skin touch guide 26 and the trimmer base 20 for upwardly moving only the members on the trimmer base 20 side.

Figure 8:
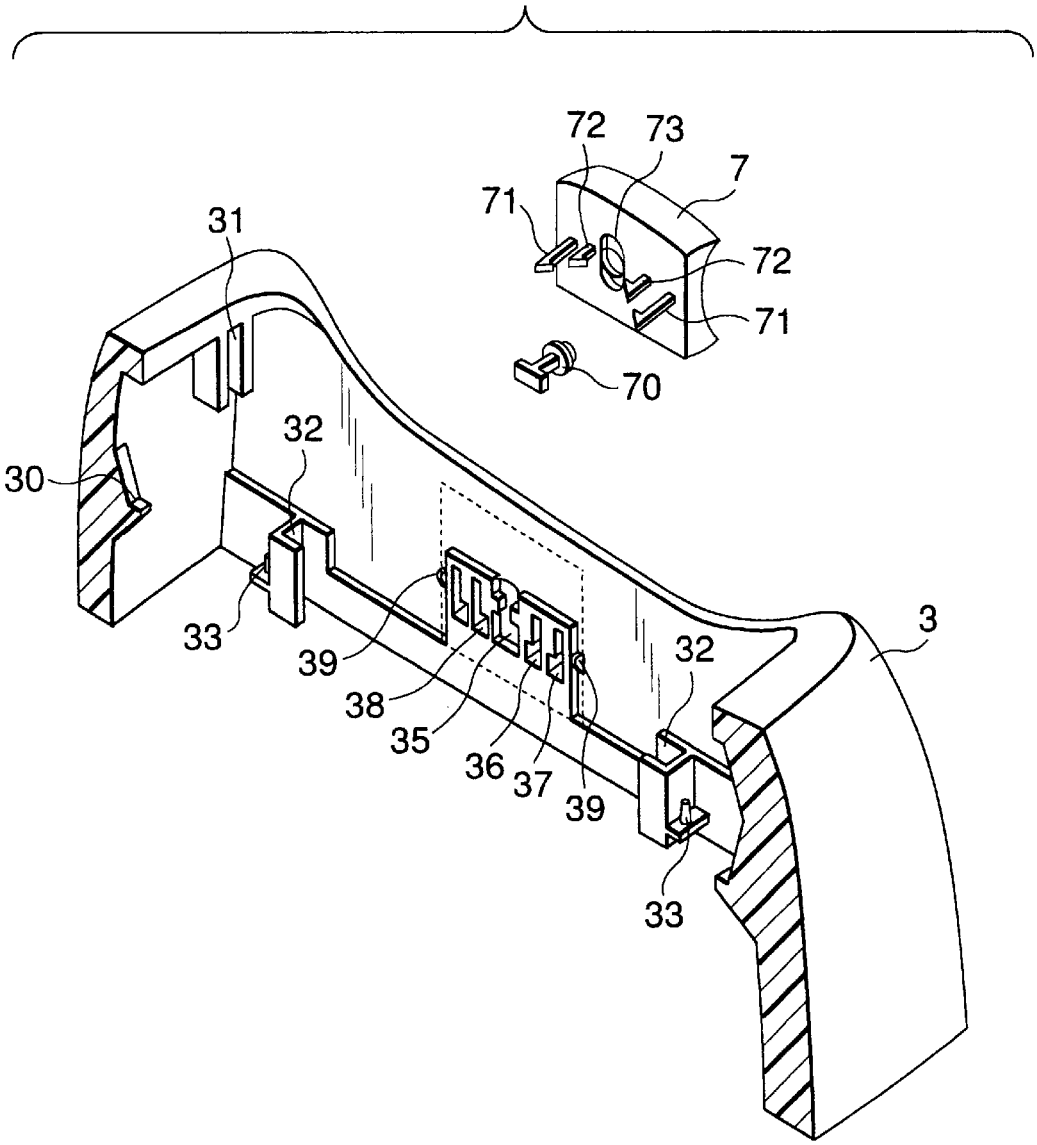
FIG. 8 is an exploded perspective view of the external cassette and the slide button of the first embodiment of the invention.

This point will be discussed. As shown in FIG. 8, the slide button 7 comprises two pairs of hooks 71 and 72 projecting to the rear and a lock button 70 attached to the center. The hooks 71 and 72 and the lock button 70 are inserted into a total of five vertically long holes 35, 36, and 37 made in the external cassette 3. Also, the hooks 71 and 72 and the lock button 70 are slidably mounted on the outer face of the external cassette 3 so as to move up and down slidably. The lock button 70 is held by being sandwiched between the slide button 7 and the external cassette 3. Slide button 7 is also fitted into a non-circular recess 73 on the rear of the slide button 7 to present rotation. Further, the tip of slide button 7 is abutted against an elastic piece 204 disposed on the trimmer base 20.

When the slide button 7 is at a low position, the portion of the lock button 70 positioned in the external cassette 3 is positioned below a projection 38 formed on both sides of the long hole 35 in the inner face of the external cassette 3. Thus, even if the slide button 7 is attempted to be moved upward, it is prevented from being moved upward by abutment of the lock button 70 and the projection 38. In this state, the hooks 71 and 72 of the slide button 7 do not hinder up or down movement of the blade head 2, so that the blade head 2 containing the skin touch guide 3 can be floated.

When the slide button 7 is in a high position, there is maintained the condition that the lock button 70 is over the projection 38 and is prevented from moving thereby. Therefore, the lock button 70 is only pushed into the slide button at the initial stage of movement from one position to the other.

Figure 14:
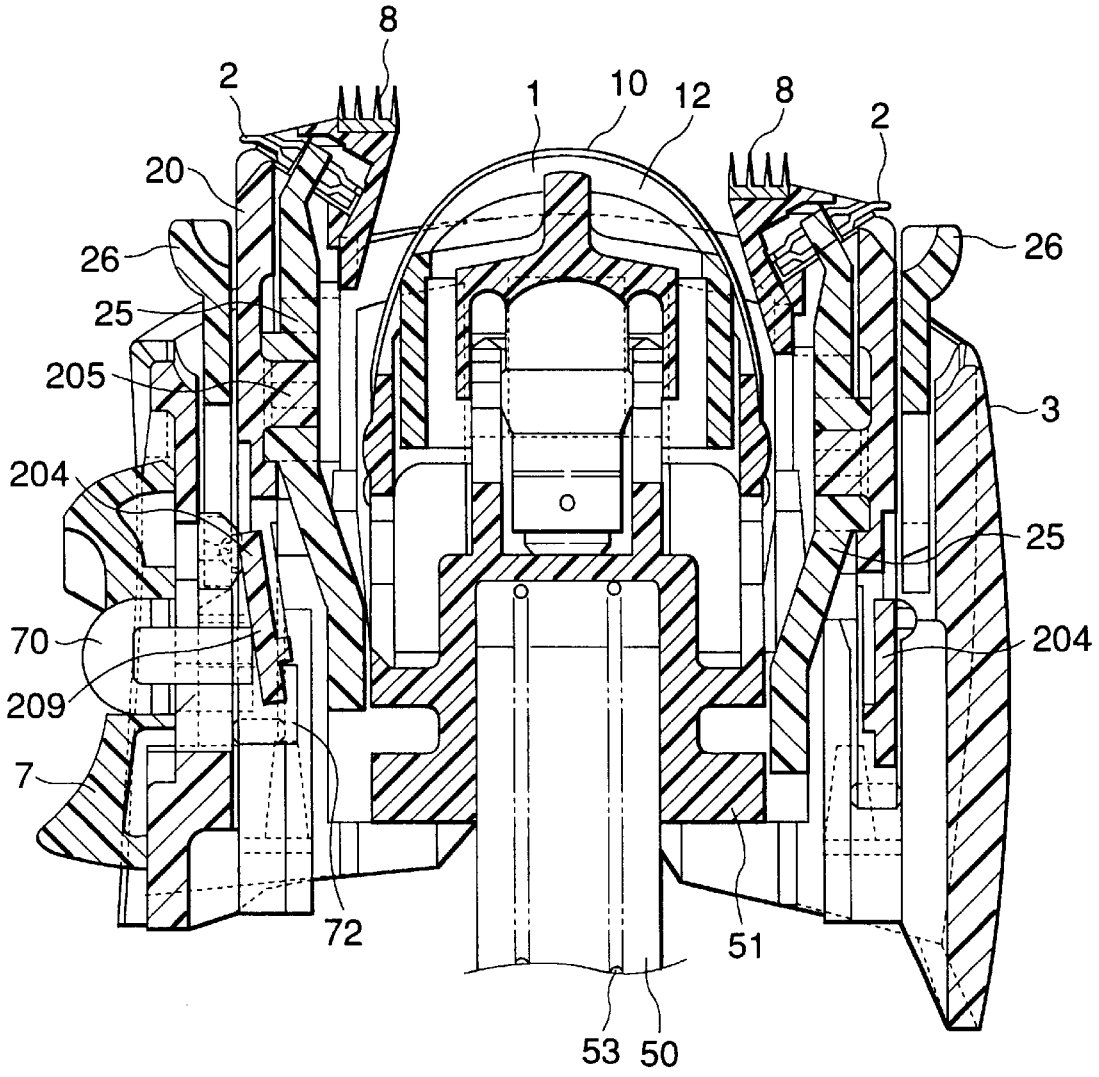
FIG. 14 is a longitudinal sectional view of an intermindate state of slid-up by pusing down the lock button.

However, if the lock button 70 is pushed in, the projection 38 of the external cassette 3 and the lock button 70 are disengaged, thus the slide button 7 can be moved upward. The pushed-in lock button 70 pushes the elastic piece 204 to the rear for positioning an engagement projection 209 on the elastic piece 204 just above the hook 72 of the slide button 7 as shown in FIG. 14. Thus, if the slide button 7 is moved up, the trimmer base 20 is also pushed and moves up.

Figure 15:
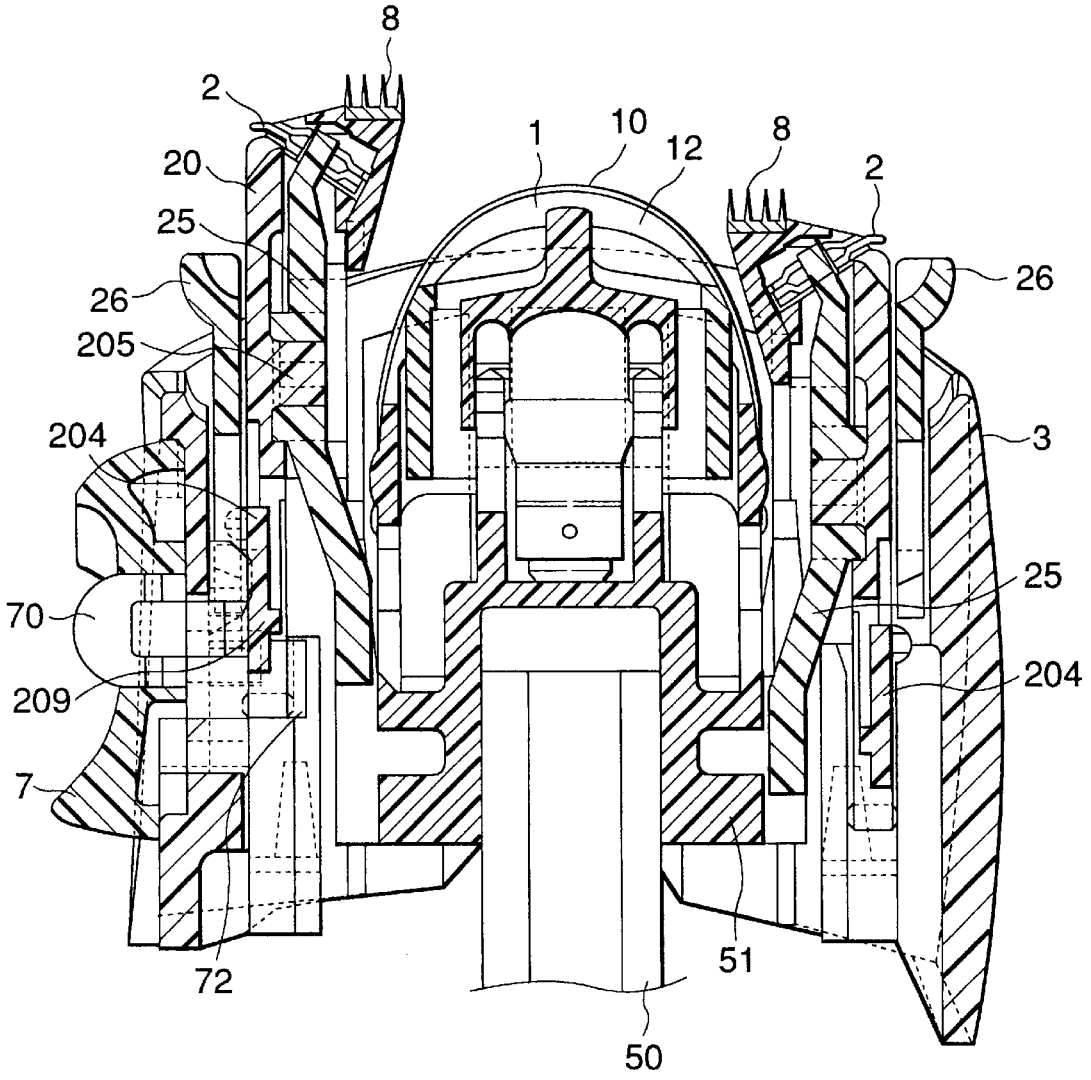
FIG. 15 is a fragmentary longitudinal sectional view in the completely slid-up state of operation.

Also, in this state, as shown in FIG. 15, the trimmer drive piece 25 engages the joint 51 and the engagement of the trimmer drive piece 25 and the joint 51 can transmit the reciprocation from the drive piece 50 to the moving blade 22. Thus, an edge cut operation is preformed by the blade head 2.

When the trimmer base 20 moves up, the push-up piece 202 gets over a release projection 39 (shown in FIG. 8) formed on the inner face of the external cassette 3 and bends to the rear, thus is dislodged from the projection piece 262 of the skin touch guide 26 placed on the push-up piece 202. The skin touch guide 26 does not follow upward motion of the trimmer base 20 and the members of the blade head 2 except the skin touch guide 26 move up in association with the slide button 7. Also in this state, the trimmer drive piece 25 engages the joint 51 and can transmit reciprocation from the drive piece 50 to the moving blade 22.

If the slide button 7 is released at the top end position in the slide range of the slide button 7, the lock button 70 receives force of the elastic piece 204 and is restored to a position above the projection 38, so that the slide button 7 cannot be moved down.

To restore the blade head 2 to the former state, the lock button 70 is again pressed and, the slide button 7 may be moved down. If the slide button 7 is moved down with the lock button 70 disengaged from the projection 38, then the hooks 71 of the slide button 7 push down the root of the push-up piece 202, thereby moving the trimmer base 20 down. When the trimmer base 20 falls, the push-up piece 202 gets caught on the release projection 39 on the inner face of the external cassette 3 and bends forward, whereby the tip of the skin touch guide 26 climbs over the push-up piece 202 and moves to the lower side of the push-up piece 202, again making the skin touch guide 26 and the trimmer base 20 integral with each other.

Figure 12:
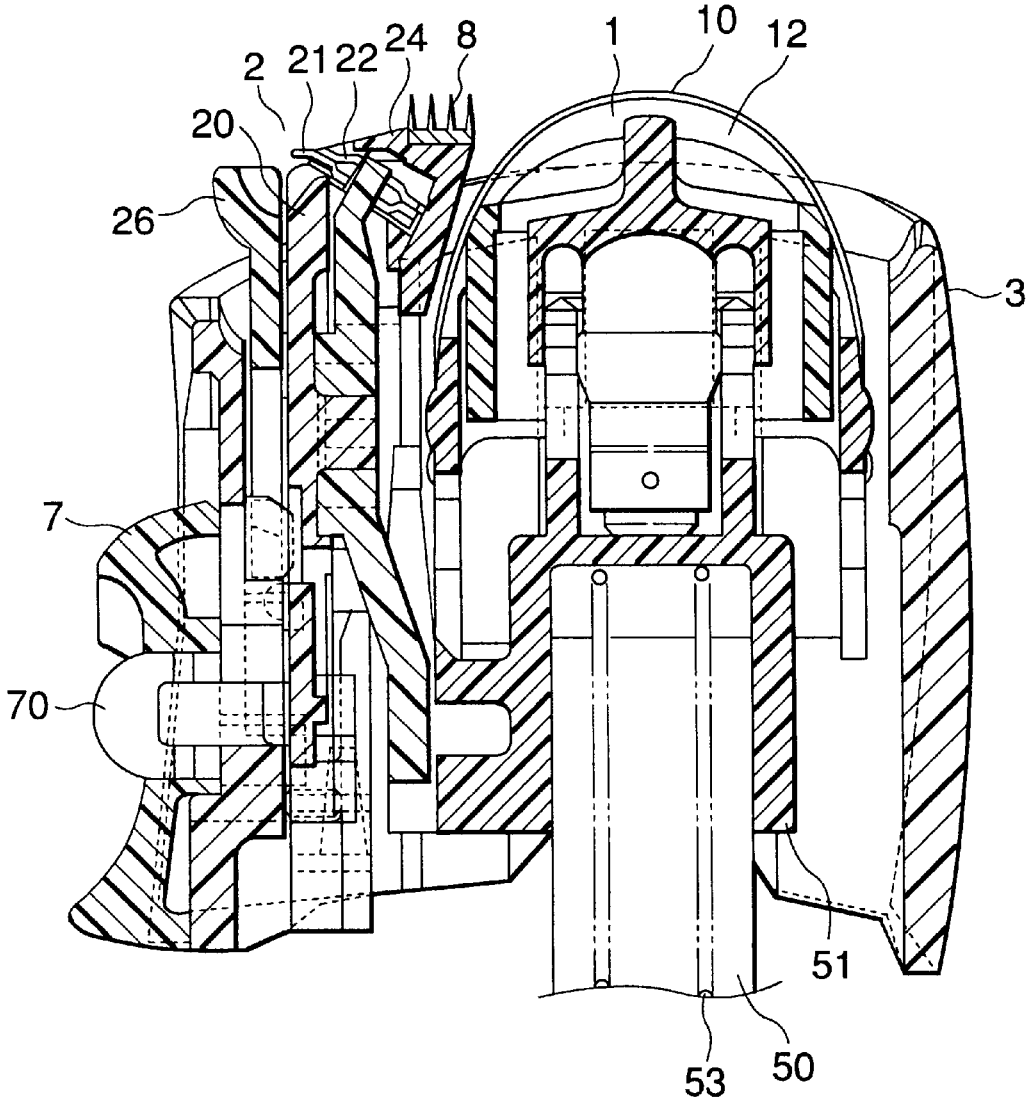
FIG. 12 is a fragmentary longitudinal sectional view of a second embodiment of the invention.
Figure 13:
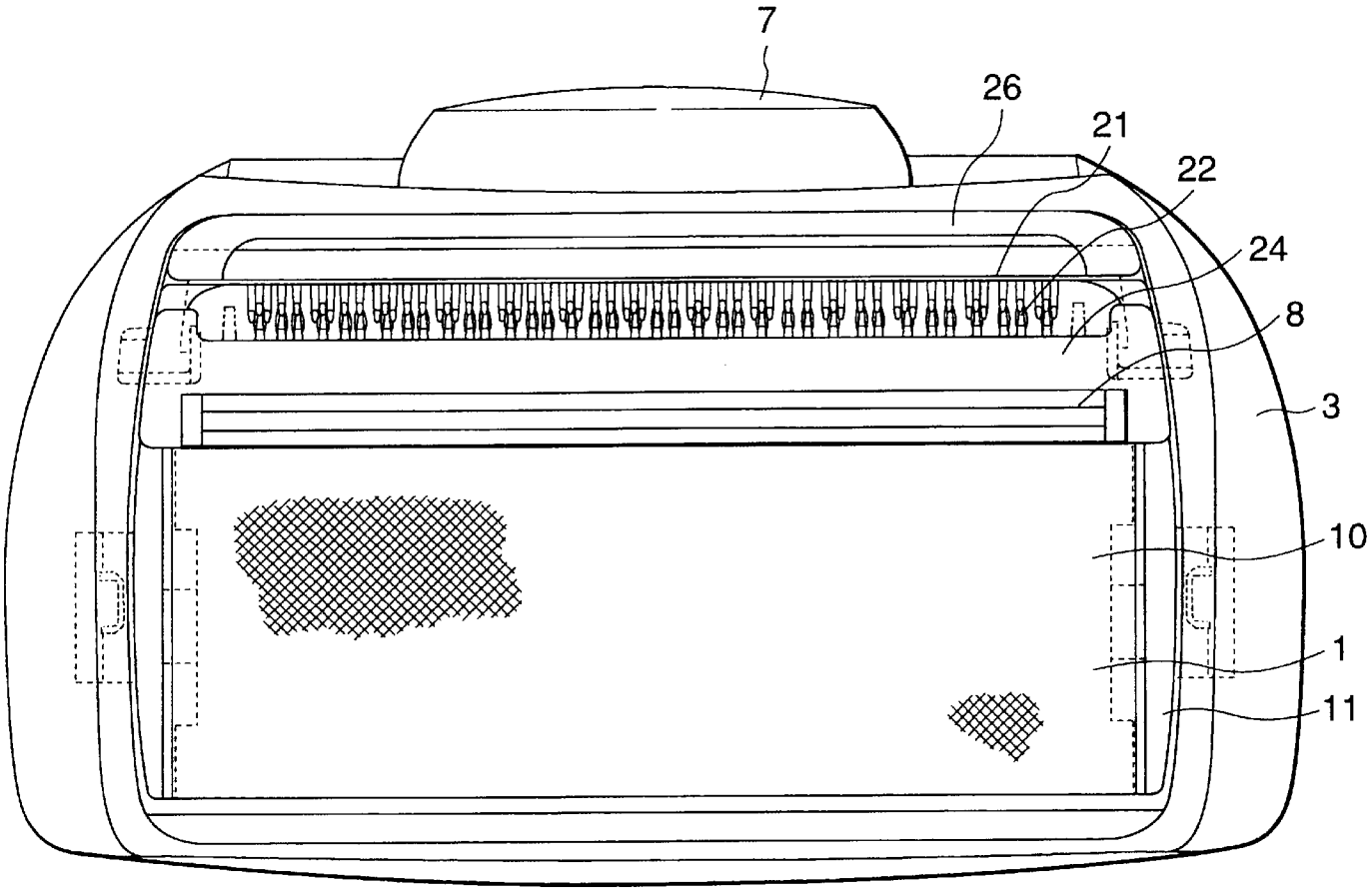
FIG. 13 is a plan view of the second embodiment of the invention.

FIGS. 12 and 13 show the electric shaver with the blade head 2 of trimmer blade type provided only on one side of the blade head 1 of the main blade.

Figure 16A:
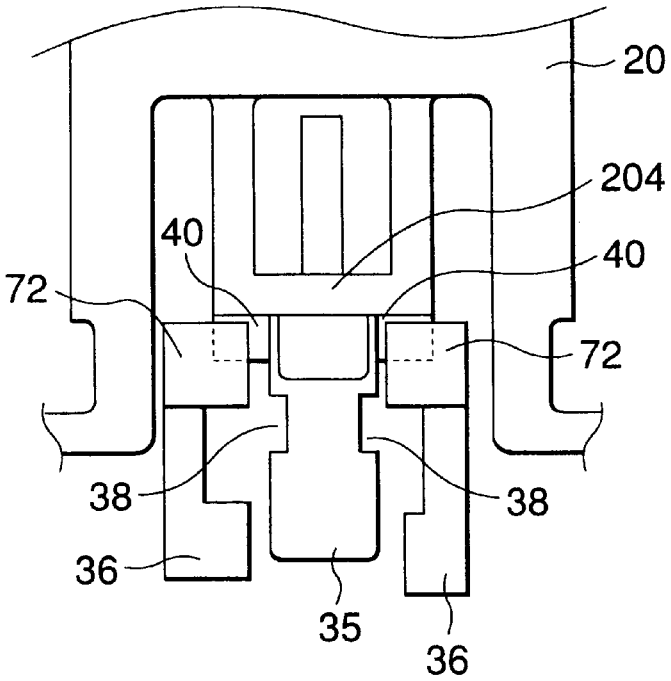
FIG. 16(*a*) and FIG. 16(*b*) are a position holding condition of the blade head in the completely slide-up state of operation.

FIG. 15 shows a sliding up state of the blade head 2. As shown in FIGS. 16 (*a*) and (*b*), this condition is maintained by holding the elastic piece 204 onto the projection 40 provided on the external cassette 3. Thus, when a pushing down force is applied to the blade head 2 by pushing the blade head 2 against the skin, the slide button 7 does not receive this force. Therefore, if the pushing down force is large, the hooks 71 and 72 of the slide button 7 will not break.

Figure 16B:
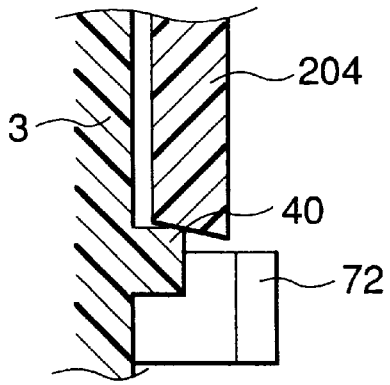

On the other hand, if the pushing force is large, the possibility of brakeage of the blade head 2 is high. In this embodiment, as shown in FIG. 16 (*b*), a portion of the elastic member 204 retained on the projection 40 is shaped in a tapered manner (or an upper surface of the projection 40 is shaped in a tapered manner) so that if the pushing down force of the blade head 2 is large, the elastic member 204 is deformed to the right side of FIG. 16B to disengage the projection 40. This action is the same as the lock button 70 being pushed down and, at this time, the lock button 70 is not urged by the elastic member 204 to easily move to the position wherein the lock button 70 is disengaged from the projection 38. Thus, the blade head 2 is slid in down side with the hook 72 (of slide button 7) which is pushed down by the elastic member 204. There is thus no brakeage of the blade head 2 or the slide button 7 due to the pushing down force described above.

Figure 17:
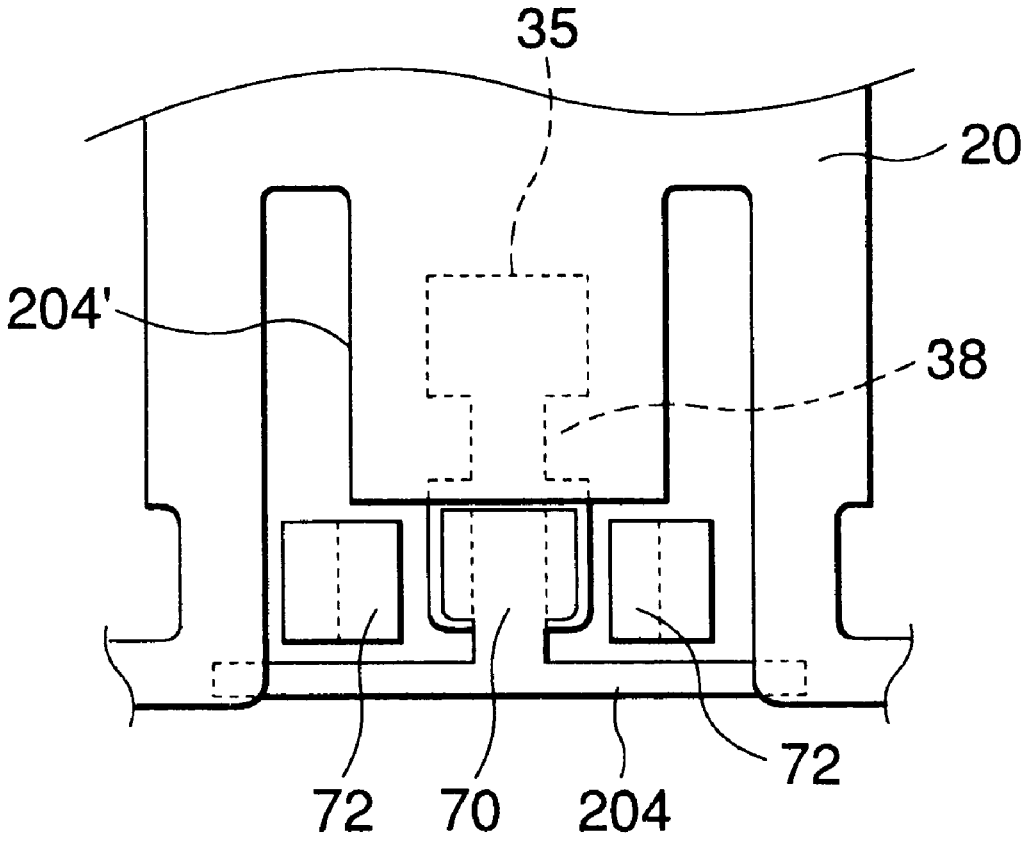
FIG. 17 is a back view of another embodiment of the present invention.

FIG. 17 shows another embodiment of the present invention, this embodiment shows that the elastic member 204 is provided on the lock button 70 so that the elastic member 204 is brought into contact with the trimmer base 20 so as to obtain an urging force for pushing the lock button 70 outer side. If the lock button 70 is not pushed down, the blade head 2 can be floated under the condition that the blade head 2 is free from the slide button 7 and the lock button 70. If the lock button 70 is pushed down, the engagement of the projection is released and a distal end of the lock button 70 is positioned under a rib 204' of the trimmer base 20. Under this condition, the slide button 7 moves upwardly so that the rib 204' is pushed up by the lock button 70 so as to move the blade head 2 upwardly.

As we have discussed, in the invention, in the electric shaver capable of rough shaving with the trimmer blades and finish shaving with the main blade at the same time, the hair raising members are projected on the blade cover covering the top faces of blade members of the trimmer blades. Thus, when the electric shaver is moved along a skin surface for introducing hair into the main blade after rough shaving, the hair raising member on the blade cover of the trimmer blades and positioned between the blade edge of the trimmer blade and the main blade not only prevents the blade cover from coming in contact with a skin surface and laying hair down, but also aggressively raises laid-down hair. Thus, the electric shaver enhances the efficiency of introducing hair into the main blade, so that a complete shave, including rapid finish shaving is achieved.

If the hair raising members are made of elastomer and are fixed to the blade cover of a molded article, they can be manufactured by molding the blade cover and the hair raising members. At this time, if the blade cover is fitted into the hair raising member in the thickness direction, the coupling strength thereof is high and the hair raising members are hard to peel off.

If the top end of the hair raising member is positioned at a height in the range of ±2 mm relative to the top of the main blade, a preferred result can be produced in points of skin touch and short hair cutting capability. Further, if the hair raising member is formed of a plurality of fine ribs, a preferred result can also be produced in points of skin touch and short hair cutting capability.

If the trimmer blade comprising the hair raising member having elasticity on the blade cover is floated, the hair raising effect of the hair raising member is provided regardless of asperities of a skin surface.

According to the present invention, an electric shaver includes the trimmer blade slidably supported and floated by a spring which urges the trimmer blade toward a projecting direction within a predetermined area, and an operation portion for subjecting the trimmer blade to a sliding operation wherein the trimmer blade extends beyond the predetermined area. The electric shaver further includes linking means arranged in such a manner that the trimmer blade and the operating portion are in a non-linking condition when the trimmer blade is floated The linking means are also arranged so that the trimmer blade and operating portion are linked when the trimmer blade is slidden by operating the operating portion to slide the trimmer blade into cooperation with the operating portion.

Thus, when the trimmer blade is not slid up by operating the operation portion, the trimmer blade and the operating portion are separated from each other. Under the this condition, the trimmer blade can be floated without the influence of a slide up movement of the operating portion to achieve a stable floating operation and to easily obtain a floating amount of the trimmer blade.

Further, lock means for restricting the movement of the operating portion is applied to the linking means. If the lock means operates to release the movement restriction of the operating portion to link the operating portion and the trimmer blade, the lock means serves as the linking means so that it is unnecessary to separately employ the linking means thereby eliminating the cumbersomeness.

Further, if an operation surface of the lock means is arranged adjacent to an operation surface of the operating portion, it is possible to simultaneously operate the lock means and the operating portion so as to enhance the operation.

The lock means is urged in a direction such that the lock means is brought into contact with the elastic portion provided with the trimmer blade. When the lock means contacts the elastic portion, the movement of the operating portion is restricted with eliminates the play of the lock means and thereby obtains good operation feeling.

Further, if there is provided a holding portion for holding the lock means under the condition that the trimmer blade is in slide operation by the operation portion within the operating portion movement restriction releasing position, it is unnecessary to operate the lock means at all times so as to enhance the operation.

The holding portion for holding the trimmer blade in the slid up condition is provided on a supporting portion of the trimmer blade, therefore when there is applied a force for pushing down the trimmer blade when the trimmer blade is slid up, this force is not applied to the operating portion so that it is possible to suitably set the operating force for the operating portion and the holding force for maintaining the slid up condition.

Since the trimmer blade is freely floated, the hair cutting efficiency of the trimmer blade is high. Moreover, the contact position between the skin and the hair raising member provided on the trimmer blade is changed due to the floating operation of the trimmer blade. When the trimmer blade is positioned on a top point of a float operation, the tip portion of the hair raising member is positioned above a line defined between the peak portion of main blade and the tip portion of comb-like blade of the trimmer blade. When the trimmer blade is positioned on a bottom point, the tip portion of the hair raising member is positioned in vicinity of the line.

As a result, when the trimmer blade 2 is positioned on the upper point, the soft hair raising member 8 is deformed at the proximal portion to raise hair as shown in FIG. 1. When the trimmer blade is positioned on the bottom point, the tip portion of the hair raising member 8 is contacted with skin to raise laid-down hair. Thus, the trimmer blade is floated, thereby ensuring that the laid-down hair raising effect is achieved.

As shown in FIG. 9, the tip portion of the hair raising member 8 is positioned below a line defined between the peak portion of main blade 1 and the tip portion of comb-like blade of the trimmer blade 2. Since the skin has flexibility, the peak portion of the main blade and the tip portion of the trimmer blade 2 are urged and pushed to the skin so that the skin is projected between the main blade and the trimmer blade. Thus, it is possible to always contact the skin with the tip portion of the hair raising member 8.

What is claimed is:

1. An electric shaver comprising:

a main blade member including an arched external blade, having a plurality of blade holes, and an internal blade slidably driven with an inner face of said external blade;

a trimmer blade arranged in the vicinity of said main blade, said trimmer blade including a comb blade having a tip portion which is directed away from said main blade; and a hair raising member provided on a blade cover for covering said comb blade of said trimmer blade, said hair raising member arranged between a peak portion of said main blade and tip portion of said comb blade of said trimmer blade, and said peak portion of said main blade, said tip portion of said comb blade of said trimmer blade, wherein said peak portion of said main blade, said tip portion of said comb blade and a tip portion of said hair raising member are approximately flush with each other.

2. An electric shaver as claimed in claim 1, wherein said trimmer blade is supported with respect to said electric shaver in such a manner that the trimmer blade is floated for up and down movement, said hair raising member is made of a soft elastomer, when said trimmer blade is positioned at a top point of its up and down movement, said tip portion of said hair raising member is positioned above a line defined between said peak portion of main blade and said tip portion of said comb blade, and when said trimmer blade is positioned on a bottom point, said tip portion of said hair raising member is positioned in the vicinity of said line.

3. An electric shaver as claimed in claim 2, wherein said trimmer blade is supported for up and down movement by a spring which urges the trimmer blade toward a projecting direction within a predetermined range of motion.

4. An electric shaver as claimed in claim 2, wherein said hair raising member includes a plurality of ribs parallel to a longitudinal direction of said trimmer blade.

5. The electric shaver as claimed in claim 4, wherein a top end of said hair raising member is positioned at a height in a range of ±2 mm relative to a top of said main blade.

6. The electric shaver as claimed in claim 2, wherein a top end of said hair raising member is positioned at a height in a range of ±2 mm relative to a top of said main blade.

7. The electric shaver as claimed in claim 1 wherein a tip portion of said hair raising member is positioned at a height in a range of ±2 mm relative to said top point of said main blade.

8. An electric shaver as claimed in claim 1, further comprising a skin touch guide connected to said trimmer blade such that said skin touch guide is movable with respect to said trimmer blade.

9. An electric shaver as claimed in claim 1, further comprising a second trimmer blade arranged in the vicinity of said main blade, said second trimmer blade including a second comb blade having a tip portion which is directed away from said main blade; and a second hair raising member provided on a blade cover for covering said second comb blade of said second trimmer.

10. An electric shaver comprising:

a trimmer blade slidably supported and freely floated for up and down movement by a spring which urges said trimmer blade toward a projecting direction within a predetermined range of motion;

an operating portion for subjecting said trimmer blade to a sliding operation wherein said trimmer blade extends beyond said predetermined range; and linking means for connecting said trimmer blade and said operating portion in such a manner that said trimmer blade and said operating portion are not linked when said trimmer blade is floated but are linked when said trimmer blade is slid up by said operating portion.

11. An electric shaver as claimed in claim 10, wherein said linking means includes lock means for reasonably restricting the movement of said operating portion.

12. An electric shaver as claimed in claim 11, wherein an operation surface of said lock means is arranged adjacent to an operation surface of said operating portion.

13. An electric shaver as claimed in claim 11, further comprising means for urging said lock means in a direction such that said lock means is brought into contact with an elastic portion provided with said trimmer blade to thereby restrict the movement of said operating portion.

14. An electric shaver as claimed in claim 11 further comprising:

a holding portion for holding said lock means in a position wherein the movement of said operating portion is not restricted and said trimmer blade is slidably supported and freely floated within said predetermined range.

15. An electric shaver as claimed in claim 10, further comprising:

a holding portion for holding said trimmer blade in the position wherein it is extended beyond said predetermined range, said holding portion being provided on a supporting portion of said trimmer blade.

16. An electric shaver as claimed in claim 10, further comprising:

a main blade member including an arched external blade, having a plurality of holes, and an initial blade slidably driven with an inner face of said external blade, said main blade arranged in the vicinity of said trimmer blade; and a hair raising member provided on a blade cover for covering said trimmer blade, wherein a top end of said hair raising member is positioned at a height in a range of ±2 mm relative to a top of said main blade.

17. An electric shaver as claimed in claim 16, further comprising a second trimmer blade arranged in the vicinity of said main blade, said second trimmer blade including a second comb blade having a tip portion which is directed away from said main blade; and a second hair raising member provided on a blade cover for covering said second comb blade of said second trimmer.

* * * * *

UNITED STATES PATENT AND TRADEMARK OFFICE

CERTIFICATE OF CORRECTION

PATENT NO. : 5,964,034
DATED : October 12, 1999
INVENTOR(S) : Hidekazu Sueyoshi and Toshio Ikuta It is certified that error appears in the above-identified patent and that said Letters Patent is hereby corrected as shown below:

Column 10,
Lines 3-5, delete "and said peak portion of said main blade, said tip portion of said comb blade of said trimmer blade,"

Signed and Sealed this

Third Day of May, 2005

JON W. DUDAS
*Director of the United States Patent and Trademark Office*